US008579221B2

(12) United States Patent
Lester et al.

(10) Patent No.: US 8,579,221 B2
(45) Date of Patent: Nov. 12, 2013

(54) COVER DEVICE FOR A SHREDDING PLANT

(75) Inventors: John Lester, Worksop (GB); Craig Rose, Sheffield (GB)

(73) Assignee: Danieli UK Holding Limited, Sheffield (GB)

( * ) Notice: Subject to any disclaimer, the term of this patent is extended or adjusted under 35 U.S.C. 154(b) by 255 days.

(21) Appl. No.: 13/001,225

(22) PCT Filed: Jun. 24, 2009

(86) PCT No.: PCT/EP2009/057920

§ 371 (c)(1),
(2), (4) Date: Mar. 15, 2011

(87) PCT Pub. No.: WO2009/156454

PCT Pub. Date: Dec. 30, 2009

(65) Prior Publication Data

US 2011/0168826 A1 Jul. 14, 2011

(30) Foreign Application Priority Data

Jun. 26, 2008 (IT) ..... UD2008A0148

(51) Int. Cl.
*B02C 7/06* (2006.01)

(52) U.S. Cl.
USPC ..... 241/285.3

(58) Field of Classification Search
USPC ..... 241/285.1–285.3
See application file for complete search history.

(56) References Cited

U.S. PATENT DOCUMENTS

| | | | | |
|---|---|---|---|---|
| 3,756,519 | A * | 9/1973 | Reynolds et al. | 241/73 |
| 3,899,965 | A * | 8/1975 | Koch et al. | 100/155 R |
| 4,212,432 | A | 7/1980 | Bohne et al. | |
| 5,657,934 | A * | 8/1997 | Pirrung et al. | 241/242 |
| 5,746,377 | A * | 5/1998 | Gehrig | 241/73 |
| 6,371,393 | B1 | 4/2002 | Kohl et al. | |
| 6,581,862 | B1 * | 6/2003 | Young et al. | 241/189.1 |
| 7,229,041 | B2 * | 6/2007 | Cohen et al. | 241/285.3 |
| 7,451,945 | B2 * | 11/2008 | Wollenhaupt et al. | 241/232 |
| 2009/0294563 | A1 * | 12/2009 | Yamashita et al. | 241/221 |
| 2011/0114776 | A1 * | 5/2011 | Veneroso et al. | 241/285.3 |

FOREIGN PATENT DOCUMENTS

GB 2178675 2/1987

OTHER PUBLICATIONS

International Search Report issued in the corresponding International Application No. PCT/EP2009/057920, dated Nov. 17, 2009 (2 pages).

Written Opinion of the International Searching Authority issued in the corresponding International Application No. PCT/EP2009/057920. Nov. 17, 2009 (5 pages).

* cited by examiner

*Primary Examiner* — Faye Francis

(74) *Attorney, Agent, or Firm* — Hamre, Schumann, Mueller & Larson, P.C.

(57) ABSTRACT

A cover device for a shredding plant, able to cover at least a shredder unit which includes a rotary drum rotatable around its own axis of rotation within a shredding chamber. The cover device includes a plurality of separation means to separate and discharge the materials arriving from shredding. The cover device includes a first element which is pivotable to the frame of the shredding plant, a second element which is pivotable to the first element, and a third element which is pivotable to the first element.

13 Claims, 2 Drawing Sheets

COVER DEVICE FOR A SHREDDING PLANT

FIELD OF THE INVENTION

The present invention concerns a cover device for a shredding plant, advantageously but not in limiting way for scarp, such as for example vehicles, trailers or other.

In particular, the cover device according to the present invention is used to cover at least a shredder unit of the scrap-shredding plant and to convey at last part of the shredded scarp. The cover device is also provided inside with separation means to separate materials, such as metal, glass, plastic or other, coming from the shredding of the scrap, as well as the cover device is provided inside with means to selectively discharge materials.

BACKGROUND OF THE INVENTION

It is known, in a scrap-shredding plant, to use a mobile cover device for a shredder unit comprising a rotary drum able to rotate inside a shredding chamber.

The cover device is made substantially in a single body and is pivoted rotatably to the frame of the plant. The cover device is also provided with a plurality of separation means to separate and discharge the materials arriving from the shredding chamber. Here and hereafter in the description by separation means we mean those screens, centrifuges, aspirators, magnets or other similar or comparable devices able to selectively separate different types of materials. These materials are subsequently conveyed to suitable compartments and/or pipes present in the plant, expelled from the plant and sent to subsequent working steps or to storage.

The cover device in its normal operating condition covers the upper portion of the drum. When it is necessary to perform maintenance operations on said separation means or on the plant, the cover device is raised and made to rotate around its pivoting center following the activation of the actuation means associated with the cover device itself. One disadvantage of the known cover device is that, in the raised condition, it does not allow easy maintenance operations on the separation means and on the plant. In fact, the cover device, since it is substantially made in a single piece, does not allow easy inspection of the separation means located inside it, and therefore, if an obstruction occurs, partial or total, of said means, the operations to restore it are somewhat difficult. Moreover, lifting the cover device allows access with relative simplicity only to the upper part of the rotary drum, whereas access to the lower part of the drum, and to the shredding chamber, is somewhat inconvenient.

To solve this problem in the state of the art a connection means is provided, selectively able to be associated with the cover device in order to allow connection between the rotor shaft of the rotary drum and the cover device, so that the drum follows the cover when the latter is raised.

The connection devices comprise two housings disposed at the opposite ends of the rotary drum. Each housing is provided with a central hole inside which the rotor shaft of the rotary drum is able to be inserted, and with two lateral holes inside which attachment pins are able to be inserted in order to achieve attachment with the cover device. The centers of the lateral holes lie on a different plane from the plane on which the center of the central hole lies.

One disadvantage of these connection devices is that, when the attachment with the cover device is made and when the latter is in its raised condition, due to the above disposition of the holes, an imbalance of forces is caused which generates shearing stresses. Therefore it is necessary to provide structural reinforcements for the cover device so as to reduce the phenomena of wear and the risk of breakages deriving from said shearing stresses.

One purpose of the present invention is to achieve a cover device for a shredding plant which facilitates the maintenance operations.

Another purpose of the present invention is to achieve a cover device selectively able to be associated with the rotary drum by means of a connection device in which the phenomena of wear and the risk of breakages are reduced.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a cover device according to the present invention is used in a scrap-shredding plant to cover at least a shredder unit comprising a rotary drum able to rotate around its own axis of rotation inside a shredding chamber. The cover device is also provided with a plurality of separation means able to separate and discharge the different materials arriving from shredding.

According to a characteristic feature of the present invention, the cover device comprises a first element, provided with first separation means, pivoted to the frame of the plant and able to be rotated from a first position, or closed position, in which the first separation means is operative and inaccessible from outside, to a second position, or raised position, in which the first separation means is inactive and accessible from outside, and vice versa; a second element provided with second separation means pivoted to the first element and able to be rotated from a first position, or closed position, in which the second separation means is operative and inaccessible from outside, to a second position, or raised position, in which the second separation means is inactive and accessible from outside, and vice versa; and a third element provided with third separation means pivoted to the first element and able to be rotated from a first position, or closed position, in which the third separation means is operative and inaccessible from outside, to a second position, or raised position, in which the third separation means is inactive and accessible from outside and vice versa.

According to a variant of the present invention the first element is able to be clamped in said closed position by means of first clamping means associated with the frame.

According to another variant of the present invention, said first element is provided with second clamping means able to clamp said second element in the closed position.

According to another variant of the present invention, said first element is provided with third clamping means able to clamp said third element in the closed position.

According to an advantageous feature of the present invention, the second element and the third element are able to rotate in opposite directions.

According to a variant of the present invention the first element is able to be selectively associated with the rotary drum by means of a connection device in such a manner that the rotary drum follows the rotation of said first element from the closed position to the raised position, and vice versa, and is respectively removed from/disposed in said shredding chamber.

According to a variant according to the present invention the connection device comprises at least two housings associated with the rotor shaft of the rotary drum and disposed at opposite ends of said shaft.

Advantageously, each housing is provided with a hole in which the rotor shaft of the rotary drum is able to be inserted, and two lateral holes in which an attachment means is able to be inserted, able to cooperate with corresponding attachment holes made in the cover device.

Advantageously, the center of the central hole and the centers of the lateral holes are disposed aligned.

The cover device according to the present invention, since it consists of at least three elements pivoted together and liftable independently with respect to each other, allows, in said raised positions, to have access to the separation means contained in each one of them with extreme facility, and therefore to carry out easy maintenance operations on the separation means. Furthermore, the association of the cover device with the rotary drum by means of a housing in which the centers of said holes are aligned, allows to have an equal distribution of forces on the housing in correspondence with the raised position of the cover device. This allows to reduce the phenomena of wear and breakage of the housing or the connection means, since they are no longer subjected to high shearing stresses.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
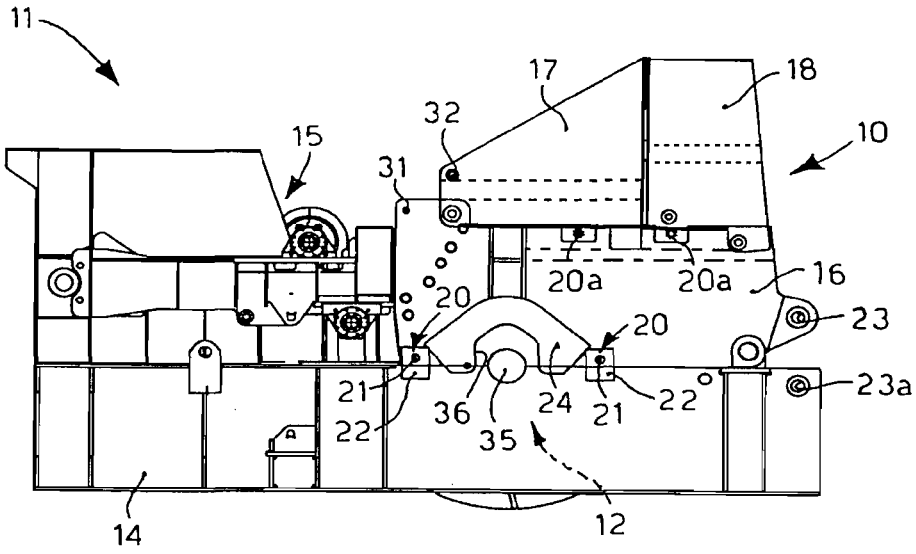
FIG. 1 is a lateral view of a scrap-shredding plant with the cover device according to the present invention in a first operating condition.
Figure 2:
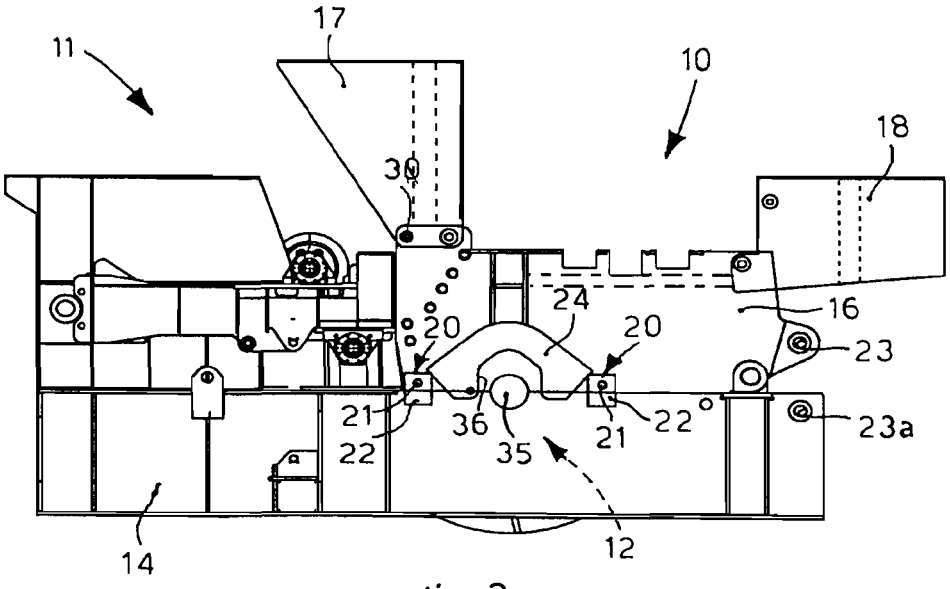
FIG. 2 is a lateral view of the plant in FIG. 1 with the cover device according to the present invention in a second operating condition.

With reference to FIG. 1, a cover device 10 is used in a scrap-shredding plant 11 to cover a shredder unit 12 comprising a rotary drum 13 able to rotate inside a shredding chamber.

The scrap-shredding plant comprises a base frame 14, with a substantially parallelepiped shape, with which a feed unit 15 to feed the scrap is associated at the upper part and at one end; the feed unit 15 is able to feed the scrap to the shredder unit 12, disposed substantially at the center of the frame 14, and to prepare it for shredding.

The cover device 10 comprises a first element 16, with a substantially parallelepiped shape, pivoted rotatably to a second end of the frame 14, opposite said first end.

The cover device 10 also comprises a second element 17, in this case having a substantially trapezoid shape, disposed on the upper surface of the first element 16 and rotatably pivoted to a first end of the first element 16.

The cover device 10 also comprises a third element 18, also substantially trapezoid in shape, disposed on the upper surface of the first element 16 and rotatably pivoted to second end of the first element 16, opposite the first end of the first element 16. The first, second and third element 16, 17 and 18 of the cover device 10 are provided inside with respective first, second and third separation means, shown as dotted lines in FIGS. 1-4 of the drawings, such as screens, centrifuges, aspirators, magnets or other similar or comparable devices able to separate and selectively discharge the different types of materials arriving from the scrap shredding.

Figure 4:
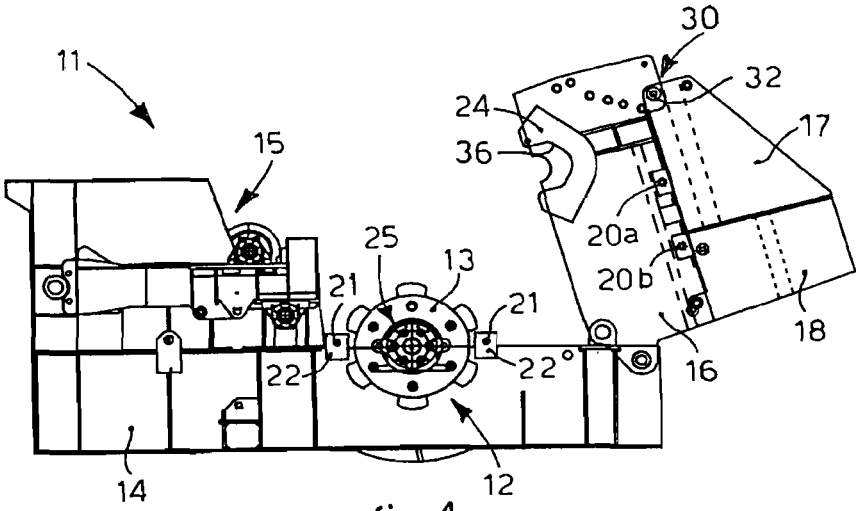
FIG. 4 is a lateral view of the plant in FIG. 1 with the cover device according to the present invention in a fourth operating condition.

The first element 16 is able to rotate, commanded by actuation means of a known type and not shown in the drawings, from a first position, or closed position, to a second position, or raised position, and vice versa. In the closed position the first separation means is operative and the first element 16 covers the rotary drum 13. In the raised position, the first separation means is inactive, accessible from the outside, and hence can be inspected, as is the rotary drum 13, which is uncovered (FIG. 4).

In the closed position, a first clamping means 20, such as pins of a known type, is able to be inserted into corresponding holes 21 made on the first element 16 and on clamping plates 22 associated with the frame 14 to allow to clamp the first element 16 to the frame 14.

It is clear that any clamping means of a known type can be used in order to clamp the first element 16 to the frame 14.

The first element 16 also comprises, substantially near the point where it pivots on the frame 14, an attachment hole 23 able to be disposed in correspondence with a hole 23 a in the frame 14, in order to allow corresponding first attachment means to be inserted, so as to keep the first element 16 in the raised position.

The second element 17 is able to be rotated, by means of actuation means of a known type and not shown in the drawings, from a first position, or closed position, in which the second separation means is operative, to a second position, or raised position, in which the second separation means is inactive and accessible from outside, and vice versa. The second element 17 is able to be kept in the closed position by means of second clamping means 20*a* on the first element 16.

The second element 17 is kept in the raised position by means of second attachment means 30, in this case a pin able to be inserted into corresponding concentric attachment holes 31, 32 made respectively on the second element 17 and on the first element 16.

Similarly, the third element 18 is able to be rotated, by means of actuation means of a known type and not shown in the drawings, in the opposite direction to the second element 17, from a first position, or closed position, in which the third separation means is operative, to a second position, or raised position, in which the third separation means is inactive and accessible from outside, and vice versa. The third element 18 is able to be kept in the closed position by means of third clamping means 20*b* on the first element.

In normal functioning conditions, the cover device 10 has all three elements 16, 17, 18 in their corresponding closed position, as shown in FIG. 1.

The three elements 16, 17, 18 of the cover device 10 are therefore able to be raised independently with respect to each other according to the maintenance operations required. It is clear that the movement of each element 16, 17, 18 requires the prior removal of the corresponding first, second and third clamping means 20, 20*a*, 20*b* which keep them in their normal functioning condition.

According to a variant of the present invention, the first element 16 is provided with two plates 24, disposed along its larger sides, able to be selectively attached to corresponding connection holes in the housings 25 associated with the rotor shaft 35 of the rotary drum 13 in correspondence with the two opposite ends of the rotor shaft 35.

Figure 3:
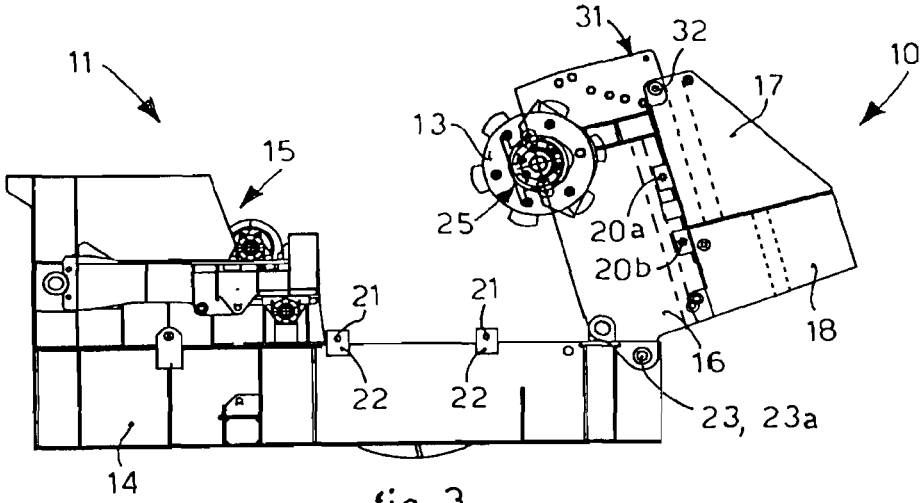
FIG. 3 is a lateral view of the plant in FIG. 1 with the cover device according to the present invention in a third operating condition.

Each plate 24 is shaped so as to define in its central part a hollow 36 for the passage of the rotor shaft 35 of the rotary drum 13. In this way, when the plate 24 and the housing 25 are attached, the rotary drum 13 can follow the rotation of the first element 16, and therefore be removed from/located in the shredding chamber (FIG. 3).

Figure 5:
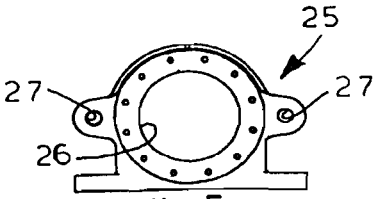
FIG. 5 is a lateral view of a detail of FIG. 4.

Each connection housing 25 (FIG. 5) is shaped so as to define a first central hole 26 inside which the rotor shaft 35 is able to be inserted, and two lateral attachment holes 27 for the insertion of corresponding attachment pins able to achieve the attachment with said plate 24.

The central hole 26 and the two lateral holes 27 are made on the housing 25 so that the respective centers are aligned. In this way, when the plate 24 and the housing 25 have been attached and with the first element 16 in the raised position, an equal distribution of the forces is achieved, which minimizes the shearing stresses, thus reducing the phenomena of wear and the risks of breakage, and which guarantees an improved stability to the association of the cover device 10 with the drum 13.

It is clear that modifications and/or additions of parts may be made to the cover device for a scrap-shredding plant as described heretofore, without departing from the field and scope of the present invention.

It is also clear that, although the present invention has been described with reference to some specific examples, a person of skill in the art shall certainly be able to achieve many other equivalent forms of cover device for a shredding plant, having the characteristics as set forth in the claims and hence all coming within the field of protection defined thereby.

The invention claimed is:

1. A cover device for a shredding plant, able to cover at least a shredder unit comprising a rotary drum able to rotate around its own axis of rotation inside a shredding chamber, said cover device being provided with a plurality of separation means to separate and discharge the materials arriving from shredding, comprising:

a first element, including a first of the plurality of separation means, wherein the first element is connected to and pivotable with respect to a frame of said shredding plant, wherein the first element is rotatable from a first position, in which said first of the plurality of separation means is operative and inaccessible from outside of the first element, to a second position, in which said first of the plurality of separation means is inactive and accessible from outside of the first element;

a second element, including a second of the plurality of separation means, wherein the second element is connected to and pivotable with respect to said first element, wherein the second element is rotatable from a first position, in which said second of the plurality of separation means is operative and inaccessible from outside of the second element, to a second position, in which said second of the plurality of separation means is inactive and accessible from outside of the second element; and a third element, including a third of the plurality of separation means, wherein the third element is connected to and pivotable with respect to said first element, wherein the third element is rotatable from a first position, in which said third of the plurality of separation means is operative and inaccessible from outside of the third element, to a second position, in which said third of the plurality of separation means is inactive and accessible from outside of the third element.

2. The cover device as in claim 1, wherein said first element is able to be clamped in the first position by first clamping means associated with the frame of the shredding plant.

3. The cover device as in claim 2, wherein said first element is provided with second clamping means able to clamp said second element in the first position.

4. The cover device as in claim 3, wherein said first element is provided with third clamping means able to clamp said third element in the first position.

5. The cover device as in claim 1, comprising first attachment means able to keep said first element in the second position.

6. The cover device as in claim 5, comprising second attachment means able to keep said second element in the second position.

7. The cover device as in claim 1, said wherein said second element and said third element are able to rotate in opposite directions.

8. The cover device as in claim 1, wherein said first element is able to be selectively associated with said rotary drum by a connection means.

9. The cover device as in claim 8, wherein said first element is connected to said rotary drum, said rotary drum is able to follow the rotation of the first element from said first position to said second position, and vice versa, and said first element can be removed from and be disposed in said shredding chamber.

10. The cover device as in claim 8, wherein said connection means comprises housings associated with the rotary drum.

11. The cover device as in claim 10, wherein each of said housings cooperates with a corresponding plate associated with said first element.

12. The cover device as in claim 11, wherein each of said housings is shaped so as to define a first hole, and at least two lateral holes, wherein a rotor shaft of the rotary drum is able to be inserted into the first hole, and an attachment means is able to be inserted in to the at least two lateral holes, in order to achieve the attachment with said corresponding plate.

13. The cover device as in claim 12, wherein said central hole and said lateral holes are aligned.

* * * * *